US011161578B2

(12) United States Patent
Wu et al.

(10) Patent No.: US 11,161,578 B2
(45) Date of Patent: Nov. 2, 2021

(54) BIOMIMETIC ROBOTIC MANTA RAY

(71) Applicant: INSTITUTE OF AUTOMATION, CHINESE ACADEMY OF SCIENCES, Beijing (CN)

(72) Inventors: Zhengxing Wu, Beijing (CN); Junzhi Yu, Beijing (CN); Yan Meng, Beijing (CN); Xingyu Chen, Beijing (CN); Jian Wang, Beijing (CN); Min Tan, Beijing (CN)

(73) Assignee: INSTITUTE OF AUTOMATION, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/278,335

(22) PCT Filed: Apr. 16, 2020

(86) PCT No.: PCT/CN2020/085044
§ 371 (c)(1),
(2) Date: Mar. 22, 2021

(87) PCT Pub. No.: WO2021/000628
PCT Pub. Date: Jan. 7, 2021

(65) Prior Publication Data

US 2021/0309332 A1 Oct. 7, 2021

(30) Foreign Application Priority Data

Jul. 4, 2019 (CN) ..... 201910599388.4

(51) Int. Cl.
*B63G 8/00* (2006.01)
*B63G 8/22* (2006.01)
(Continued)

(52) U.S. Cl.
CPC ..... *B63G 8/001* (2013.01); *B63G 8/04* (2013.01); *B63G 8/08* (2013.01); *B63G 8/22* (2013.01)

(58) Field of Classification Search
CPC . B63G 8/001; B63G 8/08; B63G 8/22; B63G 8/04
See application file for complete search history.

(56) References Cited

U.S. PATENT DOCUMENTS

2011/0281479 A1* 11/2011 Bannasch ..... B63H 1/30 440/13
2013/0220074 A1* 8/2013 Benjamin ..... B06B 1/14 74/99 R
2013/0305978 A1 11/2013 Glezer et al.

FOREIGN PATENT DOCUMENTS

CN 1962358 A 5/2007
CN 102303701 A 1/2012
(Continued)

*Primary Examiner* — Anthony D Wiest
(74) *Attorney, Agent, or Firm* — Bayramoglu Law Offices LLC

(57) ABSTRACT

A biomimetic robotic manta ray includes a head cabin, a central cabin, a pair of pectoral fins and a caudal fin cabin. The pectoral fin includes a crank-rocker mechanism and a bevel gear mechanism. The biomimetic robotic manta ray achieves undulatory propulsion through a coordinated periodic motion of the crank-rocker mechanism. A complex closed motion trail of the tail end of the pectoral fin of the manta ray is traced through the coordination of the bevel gear mechanism and the crank-rocker mechanism. The biomimetic robotic manta ray achieves a combined motion of two vertical undulations superimposed on the pectoral fin of a natural manta ray. The motion trail, which has an important effect on the efficient motion of the manta ray, of the tail end of the pectoral fin is approximately simulated.

10 Claims, 7 Drawing Sheets

(51) Int. Cl.
*B63G 8/08* (2006.01)
*B63G 8/04* (2006.01)

(56) References Cited

FOREIGN PATENT DOCUMENTS

| | | | |
|---|---|---|---|
| CN | 103144756 | A | 6/2013 |
| CN | 203186566 | U | 9/2013 |
| CN | 104943839 | A | 9/2015 |
| CN | 106005338 | A | 10/2016 |
| CN | 107021223 | A | 8/2017 |
| CN | 109229311 | A | 1/2019 |
| CN | 109319075 | A | 2/2019 |
| CN | 110304223 | A | 10/2019 |
| EP | 2857869 | A1 | 4/2015 |
| JP | 2000272582 | A | 10/2000 |

* cited by examiner

BIOMIMETIC ROBOTIC MANTA RAY

CROSS REFERENCE TO THE RELATED APPLICATIONS

This application is the national phase entry of International Application No. PCT/CN2020/085044, filed on Apr. 16, 2020, which is based upon and claims priority to Chinese Patent Application No. 201910599388.4, filed on Jul. 4, 2019, the entire contents of which are incorporated herein by reference.

TECHNICAL FIELD

The present invention belongs to the technical field of biomimetic robotics, and specifically relates to a biomimetic robotic manta ray.

BACKGROUND

Manta rays, belonging to the order Batoidea, are the largest group of more than 500 species of rays. Unlike typical fish that use body-caudal fin (BCF) propulsion, manta rays use median-paired fin (MPF) propulsion. The MPF propulsion mode features high motion stability, low-speed maneuverability and high propulsion efficiency. As a typical example, manta birostris is known for its stable, efficient swimming and exceptional gliding performance. On one hand, manta birostris can achieve a swimming speed of 0.25-0.47 m/s and a swimming efficiency of up to 89% by flapping their wide and flat pectoral fins on both sides. On the other hand, manta birostris can migrate as far as 1500 m by relying on gliding. Moreover, through the coordination of their pectoral fins, manta birostris can leap 1.5 m out of water in the way of rotary rise, which exhibits their superb motion ability.

Attracted by the excellent swimming ability of manta rays, numerous Chinese and foreign researchers have successfully developed various types of biomimetic robotic manta rays. These biomimetic robotic manta rays are generally divided into two categories according to their different driving modes. The first category is motor-driven biomimetic robotic manta rays, such as the Ro-man I-III developed by Nanyang Technological University (NTU) and the Robo-Ray I-IV developed by Beihang University (BHU). Such biomimetic robotic manta rays have certain maneuverability and gliding ability, but have a motion form that is greatly simplified due to the limitation of their rigid structures and thus have a swimming performance that is far inferior to that of natural manta rays. The second category is biomimetic robotic manta rays driven by smart materials such as shape memory alloy (SMA) and artificial muscles, for example, the Aqua Ray developed by German company Festo. The smart material-driven mode endows the biomimetic robotic manta ray with more degrees of freedom, making it closer to the motion state of a natural manta ray and gain higher swimming efficiency. However, the limited driving capability of these materials greatly restricts the volume and speed of the biomimetic robotic manta ray. Hence, although the existing biomimetic robotic manta rays have achieved simple manta ray-like motions, they are still far behind natural manta rays in terms of speed, efficiency and gliding performance.

Studies have proved that the wide and flat pectoral fins of a manta ray are the key to its efficient swimming. When the manta ray moves stably in a straight line, its pectoral fins, as the main source of thrust, not only exhibit chordwise undulations along the direction of the water flow but also exhibit spanwise undulations along the direction extending from the body baseline. Further studies have proved that the net thrust of a manta ray is mainly produced in a small area at the tail end of the pectoral fin, and the motion trail of the tail end of the pectoral fin has an important effect on its swimming efficiency. Additionally, manta rays can also control their pectoral fins and net buoyancy to accomplish stable gliding and long-distance sailing.

The pectoral fins of a biomimetic robotic manta ray are critical to its motion speed, efficiency and gliding performance. In this regard, it is highly desirable to develop a multi-degree-of-freedom pectoral fin mechanism capable of achieving undulatory propulsion of the biomimetic robotic manta ray and optimizing the tail end trail of the pectoral fin. Meanwhile, a water suction and drainage mechanism is employed to enable the biomimetic robotic manta ray to perform gliding motion, thereby improving the endurance and distance of the biomimetic robotic manta ray and strengthening its capabilities to carry out underwater surveillance, underwater search and rescue, and underwater survey.

SUMMARY

In order to solve the above-mentioned problem that underwater biomimetic robotic manta rays in the prior art have a slow speed, low efficiency, poor swimming performance and single swimming mode, the present invention provides a biomimetic robotic manta ray, including a head cabin, a central cabin, a pair of pectoral fins, a caudal fin cabin and a control assembly. The head cabin is located at the front end of the biomimetic robotic manta ray. The central cabin and the caudal fin cabin are sequentially connected to the rear of the head cabin. The pair of pectoral fins are symmetrically arranged on the left side and the right side of the central cabin.

Each of the pair of pectoral fins includes a pectoral fin body. The pair of pectoral fin bodies are separately driven by a first power device to be rotatably mounted on a fixing member around a substantially anteroposterior axis. The two fixing members are separately driven by a second power device to be rotatably mounted in the central cabin around a substantially vertical axis. A control terminal of the first power device and a control terminal of the second power device both communicate with the control assembly through a signal.

In some preferred technical solutions, the central cabin is provided with a water suction and drainage mechanism. A control terminal of the water suction and drainage mechanism communicates with the control assembly through a signal to enable the biomimetic robotic manta ray to float or submerge.

In some preferred technical solutions, the caudal fin cabin includes a caudal fin body and a third power device. The third power device communicates with the control assembly through a signal. The third power device is configured to drive the caudal fin body to rotate around a substantially left-right axis to enable the biomimetic robotic manta ray to perform a pitching motion.

In some preferred technical solutions, each pectoral fin body of the pair of pectoral fins includes at least two crank-rocker mechanisms arranged front and back and flexible membranes unfolded by the at least two crank-rocker mechanisms.

The second power device drives the fixing member to rotate through a bevel gear mechanism.

In some preferred technical solutions, the structure of the crank-rocker mechanism specifically includes a crank, a rocker, a connecting rod assembly and an L-shaped driven rod. The crank is rotatably connected to one end of the rocker, and the other end of the rocker is rotatably connected to the L-shaped driven rod through the connecting rod assembly.

The connecting rod assembly has a support point fixed to the first power device. The connecting rod assembly includes two connecting rods with the same length. The two connecting rods with the same length are arranged in parallel between the rocker and the L-shaped driven rod. Both ends of each of the two connecting rods with the same length are rotatably connected to the rocker and the L-shaped driven rod.

The first power device drives the crank to drive the entire crank-rocker mechanism to rotate.

In some preferred technical solutions, the pectoral fin body relies on the coordination of the crank-rocker mechanism to perform a periodic motion to enable the biomimetic robotic manta ray to perform undulatory propulsion. When a left-right motion of the crank-rocker mechanism is asymmetric, a roll angle and a yaw angle of the biomimetic robotic manta ray are changed.

In some preferred technical solutions, each pectoral fin body of the pair of pectoral fins includes a gear sleeve coupling. The gear sleeve coupling is configured to change a phase difference of the crank-rocker mechanism along a chordwise direction of a water flow.

In some preferred technical solutions, the water suction and drainage mechanism includes a flexible water storage tank. The flexible water storage tank communicates with the outside of a shell of the biomimetic robotic manta ray. The water suction and drainage mechanism is configured to enable the flexible water storage tank to draw or drain water.

In some preferred technical solutions, the water suction and drainage mechanism further includes a fourth power device, and the fourth power device communicates with the control assembly through a signal. The drainage volume of the flexible water storage tank is driven by the fourth power device to change to adjust the center of gravity and buoyancy of the biomimetic robotic manta ray.

In some preferred technical solutions, an information acquisition unit is mounted in the head cabin, and the information acquisition unit communicates with the control assembly through a signal.

In some preferred technical solutions, the control assembly includes a control unit and a battery pack unit. The control unit includes an underlying control chip and a high-performance processing chip.

The present invention has the following advantages.

The biomimetic robotic manta ray of the present invention accurately reproduces the motion mode of the pectoral fins of a natural manta ray through the parallel crank-rocker mechanisms. On one hand, a rigid drive rod provides sufficient power to ensure the swimming speed of the biomimetic robotic manta ray. On the other hand, the accurate reproduction of the motion mode of the pectoral fins of the natural manta ray ensures high swimming efficiency of the biomimetic robotic manta ray.

In addition to the undulatory propulsion mode, the biomimetic robotic manta ray of the present invention relies on a newly designed water suction and drainage mechanism to achieve gliding motion. In the undulatory propulsion mode, the biomimetic robotic manta ray adjusts its roll, yaw and pitch attitudes through a pair of pectoral fins and a caudal fin with high flexibility.

In the gliding and swimming mode, the biomimetic robotic manta ray adopts a buoyancy-driven method, which consumes less energy and thus has a strong endurance.

The biomimetic robotic manta ray of the present invention adopts an undulatory propulsion method, and thus has high stability when swimming. The biomimetic robotic manta ray can be equipped with vision, depth and other sensors to perform a series of underwater operations, and thus has broad application prospects in underwater environment monitoring, underwater survey, and the like.

The biomimetic robotic manta ray of the present invention is modularly designed to facilitate disassembly and maintenance.

BRIEF DESCRIPTION OF THE DRAWINGS

Other features, objectives and advantages of this application will become more apparent upon reading the detailed description of the non-restrictive embodiments with reference to the drawings.

DETAILED DESCRIPTION OF THE EMBODIMENTS

Figure 1:
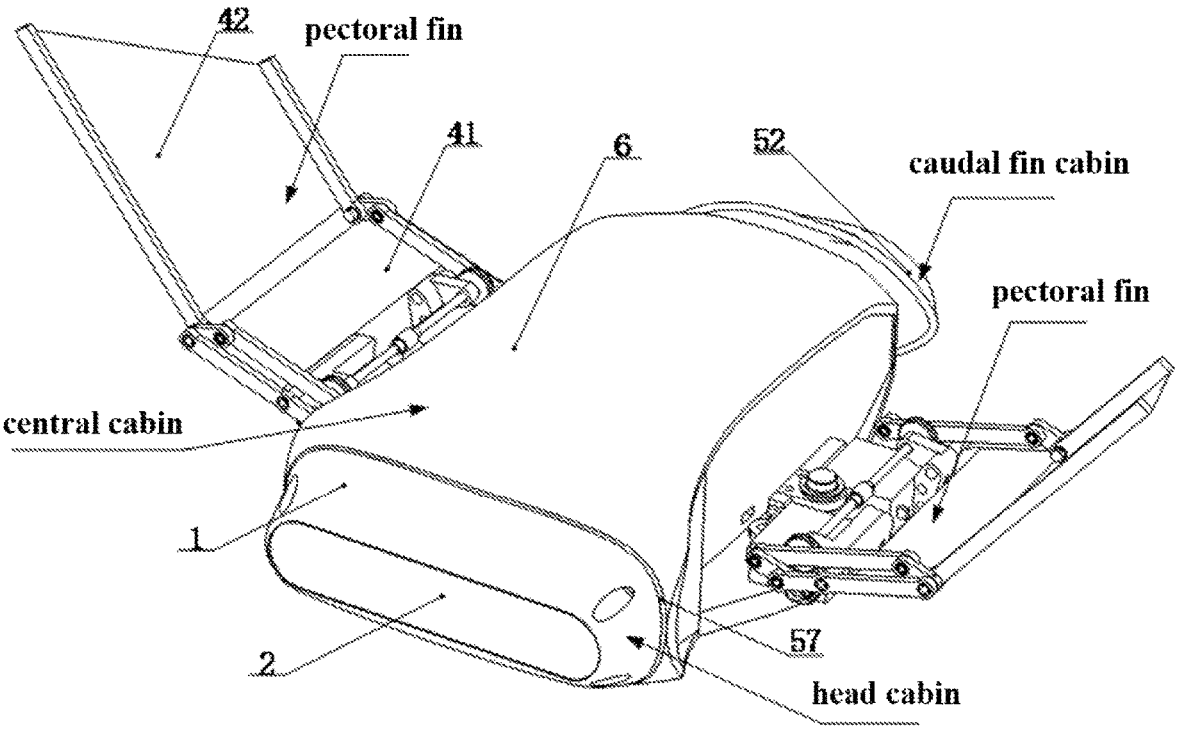
FIG. 1 is a schematic view of the overall structure of a biomimetic robotic manta ray according to an embodiment of the present invention.

In order to make the embodiments, technical solutions and advantages of the present invention clearer, the technical solutions of the present invention are clearly and completely described below with reference to the drawings. Apparently, the described examples are part rather than all of the embodiments. Those skilled in the art should understand that the implementations herein are merely intended to explain the technical principles of the present invention, rather than to limit the scope of protection of the present invention.

The present invention provides a biomimetic robotic manta ray. The biomimetic robotic manta ray includes a head cabin, a central cabin, a pair of pectoral fins, a caudal fin cabin and a control assembly. The head cabin is located at the front end of the biomimetic robotic manta ray. The central cabin and the caudal fin cabin are sequentially connected to the rear of the head cabin. The pair of pectoral fins are symmetrically arranged on the left side and the right side of the central cabin.

Each of the pair of pectoral fins includes a pectoral fin body. The pair of pectoral fin bodies are separately driven by a first power device to be rotatably mounted on a fixing member around a substantially anteroposterior axis. The two fixing members are separately driven by a second power device to be rotatably mounted in the central cabin around a substantially vertical axis. A control terminal of the first power device and a control terminal of the second power device both communicate with the control assembly through a signal.

In some embodiments of the present invention, the central cabin is provided with a water suction and drainage mechanism. A control terminal of the water suction and drainage mechanism communicates with the control assembly through a signal to enable the biomimetic robotic manta ray to float or submerge.

In some embodiments of the present invention, the caudal fin cabin includes a caudal fin body and a third power device. The third power device communicates with the control assembly through a signal. The third power device is configured to drive the caudal fin body to rotate around a substantially left-right axis to enable the biomimetic robotic manta ray to perform a pitching motion.

In some embodiments of the present invention, each pectoral fin body of the pair of pectoral fins includes at least two crank-rocker mechanisms arranged front and back and flexible membranes unfolded by the at least two crank-rocker mechanisms.

The second power device drives the fixing member to rotate through a bevel gear mechanism.

In some embodiments of the present invention, the structure of the crank-rocker mechanism specifically includes a crank, a rocker, a connecting rod assembly and an L-shaped driven rod. The crank is rotatably connected to one end of the rocker, and the other end of the rocker is rotatably connected to the L-shaped driven rod through the connecting rod assembly.

The connecting rod assembly has a support point fixed to the first power device. The connecting rod assembly includes two connecting rods with the same length. The two connecting rods with the same length are arranged in parallel between the rocker and the L-shaped driven rod. Both ends of each of the two connecting rods with the same length are rotatably connected to the rocker and the L-shaped driven rod.

The first power device drives the crank to drive the entire crank-rocker mechanism to rotate.

In some embodiments of the present invention, the pectoral fin body relies on the coordination of the crank-rocker mechanism to perform a periodic motion to enable the biomimetic robotic manta ray to perform undulatory propulsion. When the left-right motion of the crank-rocker mechanism is asymmetric, the roll angle and the yaw angle of the biomimetic robotic manta ray are changed.

In some embodiments of the present invention, each pectoral fin body of the pair of pectoral fins includes a gear sleeve coupling. The gear sleeve coupling is configured to change a phase difference of the crank-rocker mechanism along a chordwise direction of a water flow.

In some embodiments of the present invention, the water suction and drainage mechanism includes a flexible water storage tank. The flexible water storage tank communicates with the outside of the shell of the biomimetic robotic manta ray. The water suction and drainage mechanism is configured to enable the flexible water storage tank to draw or drain water.

In some embodiments of the present invention, the water suction and drainage mechanism further includes a fourth power device. The fourth power device communicates with the control assembly through a signal. The drainage volume of the flexible water storage tank is driven by the fourth power device to change to adjust the center of gravity and buoyancy of the biomimetic robotic manta ray.

In some embodiments of the present invention, an information acquisition unit is mounted in the head cabin, and the information acquisition unit communicates with the control assembly through a signal.

In some embodiments of the present invention, the control assembly includes a control unit and a battery pack unit. The control unit includes an underlying control chip and a high-performance processing chip.

In order to more clearly describe the biomimetic robotic manta ray, a preferred embodiment of the present invention is described in detail below with reference to the drawings.

In a preferred embodiment of the present invention, the biomimetic robotic manta ray of the present invention adopts a detachable modular design, and includes a head cabin, a central cabin, a pair of pectoral fins and a caudal fin cabin.

As shown in FIG. 1, the overall shape of the biomimetic robotic manta ray imitates a streamlined design of a natural manta ray. The structure of the biomimetic robotic manta ray mainly includes a head cabin, a central cabin, a pair of pectoral fins and a caudal fin cabin. The head cabin is located at the foremost end of the biomimetic robotic manta ray, the central cabin is located in the middle of the body of the biomimetic robotic manta, and the caudal fin cabin is mounted at the rear of the central cabin. The pair of pectoral fins are symmetrically arranged on the left side and the right side of the central cabin. In order for better description and definition of the same level, in this preferred embodiment, the pectoral fin mounted on the left of the central cabin is designated as a left pectoral fin, and the pectoral fin mounted on the right of the central cabin is designated as a right pectoral fin.

Figure 2:
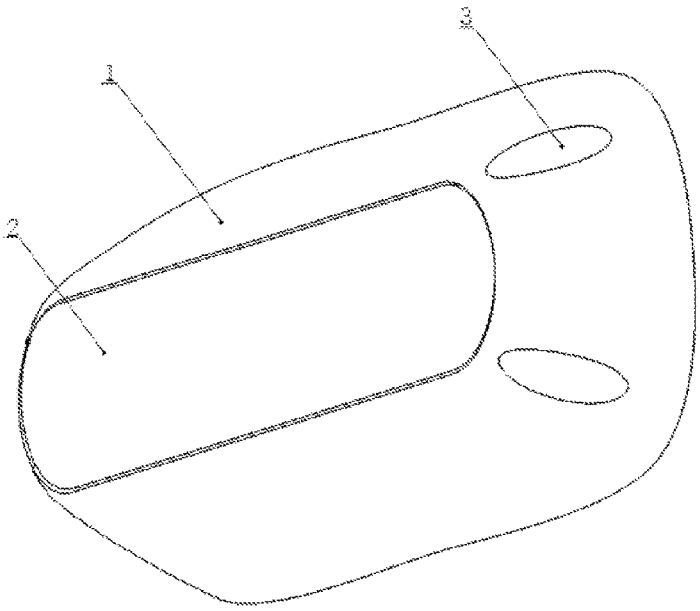
FIG. 2 is a schematic view of the exterior of a head cabin of the biomimetic robotic manta ray according to the embodiment of the present invention.
Figure 3:
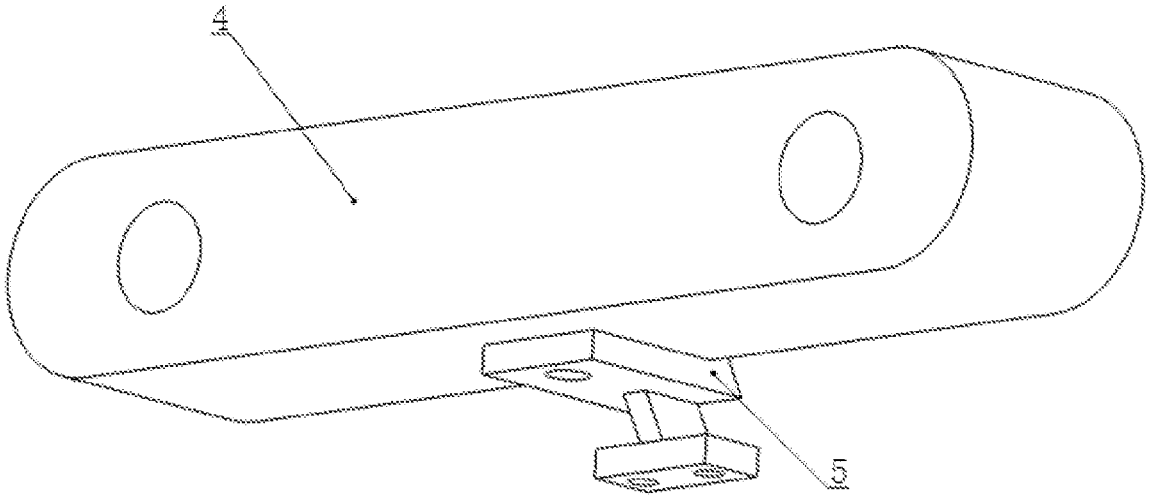
FIG. 3 is a schematic view of the interior of the head cabin of the biomimetic robotic manta ray according to the embodiment of the present invention.

The basic function of the head cabin is to provide space for mounting an information acquisition unit. FIG. 2 shows the external design of the head cabin, and the head cabin includes the head shell 1 and the transparent window 2. The head shell 1 is a hard opaque shell with four counterbored holes 3 that are scattered and configured to connect the central cabin. The transparent window 2 serves as a view window for the information acquisition unit. The information acquisition unit inside the head cabin is shown in FIG. 3. In the present embodiment, the information acquisition unit mainly includes the depth camera 4 and the camera mount 5. The depth camera 4 is fixedly connected to the camera mount 5 through a threaded hole and a slot, and the camera mount 5 is further fixed in the central cabin. The depth camera 4 captures an image of an object in front of the biomimetic robotic manta ray and information of the underwater objects through the transparent window 2, and is configured to measure the distance from the object in front to determine whether there is an obstacle in front. The depth camera 4 communicates with a control assembly fixed in the central cabin through a signal, so that the control assembly adjusts, through control, the swimming posture of the underwater biomimetic robotic manta ray in time. Those skilled in the art may choose the information acquisition unit at will according to practical applications, as long as the information acquisition unit can acquire the image of the object in front and three-dimensional geometric information of the underwater objects and send a processing result to the control assembly. The information acquisition unit may further include a radar, an ultrasonic detector and other device, which will not be described in detail herein.

Figure 4:
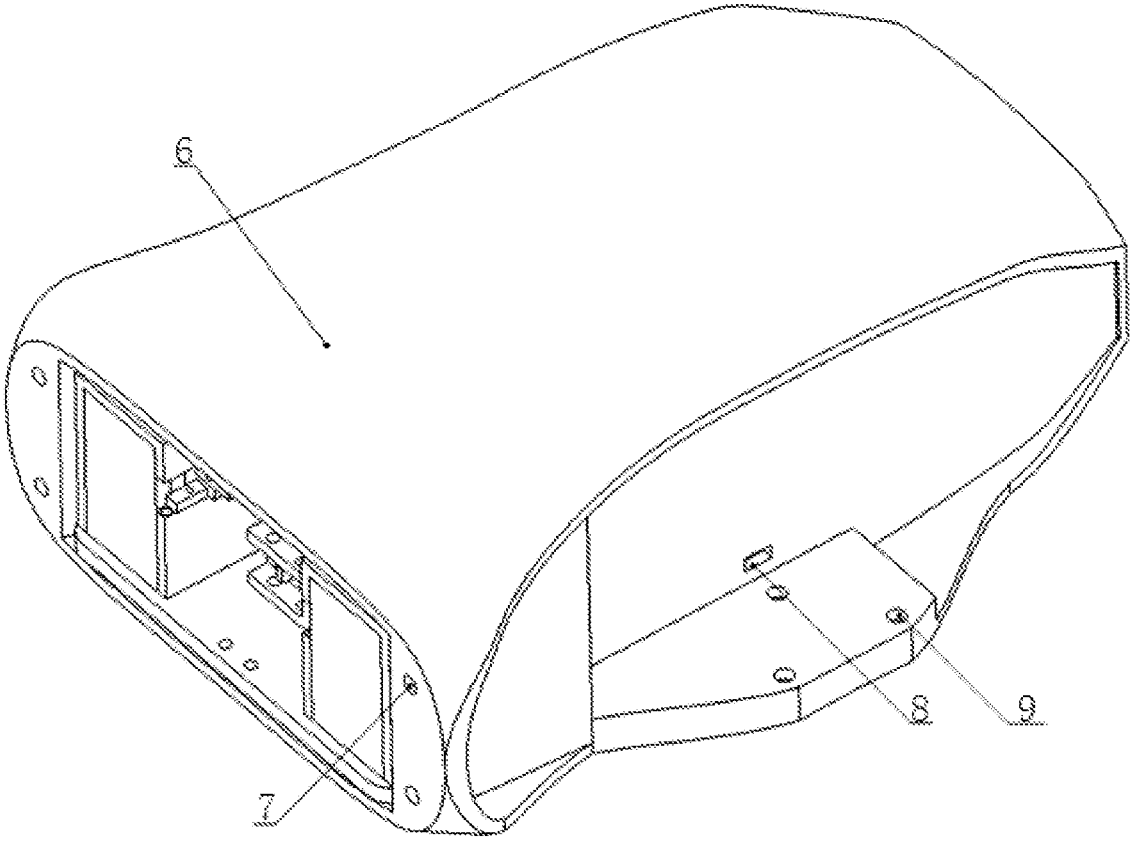
FIG. 4 is a schematic view of the exterior of a central cabin of the biomimetic robotic manta ray according to the embodiment of the present invention.
Figure 5:
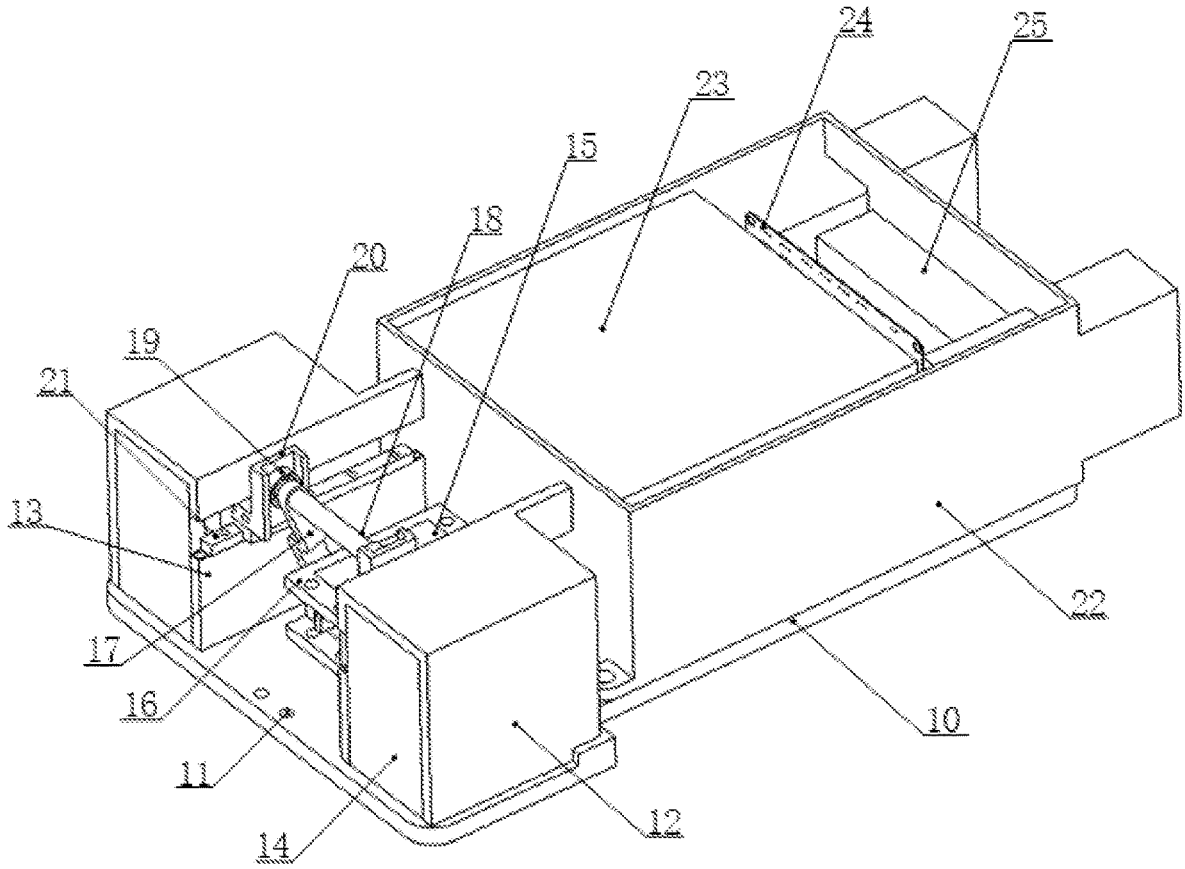
FIG. 5 is a schematic view of the interior of the central cabin of the biomimetic robotic manta ray according to the embodiment of the present invention.

Referring to FIG. 4, the external design of the central cabin is shown, and the central cabin mainly includes the central cabin shell 6, the water suction and drainage mechanism and the control assembly. The central cabin shell 6 is provided with mounting holes 7 that are scattered and close to the head cabin. The mounting holes 7 correspond to the counterbored holes 3 of the head cabin and are configured to fixedly connect the head cabin and the central cabin. In order to ensure a good seal, as shown in FIG. 1, the special annular rubber ring 57 is mounted at the connection of the head cabin and the central cabin. In addition, three threaded holes 9 are formed on each of the left side and the right side of the central cabin to facilitate supporting and fixing the left pectoral fin and the right pectoral fin. The wiring hole 8 is formed near the threaded holes 9 and configured to connect the left pectoral fin and the right pectoral fin to the control assembly. FIG. 5 shows the internal structure of the central cabin, in which all components are directly or indirectly fixed on the rigid bottom plate 10. Threaded holes 11 are formed in the front of the rigid bottom plate 10 and configured to fix the camera mount 5. The central cabin shell 6 imitates a streamlined appearance design of a natural manta ray, and is hard and opaque and thus maintains a small deformation under a certain water pressure to prevent the biomimetic robotic manta ray from greatly changing in volume under different water depths.

The water suction and drainage mechanisms are symmetrically arranged in the central cabin. The water suction and drainage mechanism includes flexible water storage tanks, a pair of upper cabin bodies 12 and a pair of lower cabin bodies 13. The upper cabin body 12 and the lower cabin body 13 are configured to fix the front end surface of the flexible water storage tank and limit the movement range thereof. In the present invention, the water storage tank 14 is preferably made of rubber, which has good sealing performance, high elasticity, low cost and is readily available. Those skilled in the art may also flexibly choose the material of the flexible water storage tank according to practical applications. The rubber water storage tank 14 has a water outlet, and the water outlet communicates with the external environment of the shell of the biomimetic robotic manta ray. The water suction and drainage mechanism enables the rubber water storage tank to draw or drain water to adjust the center of gravity and buoyancy of the biomimetic robotic manta ray.

A fourth power device is further provided in the middle of the water suction and drainage mechanism. The fourth power device communicates with the control assembly through a signal. The fourth power device functions to drive the drainage volume of the rubber water storage tank 14 to change to adjust the center of gravity and buoyancy of the biomimetic robotic manta ray. In the present embodiment, the servomotor 15 serves as the fourth power device, and the servomotor 15 is fixed to the rigid bottom plate 10 through the servomotor fixing frame 16. The output teeth of the servomotor 15 are fixedly connected to the special-shaped connecting rod 17, and the special-shaped connecting rod 17 and an opposite driven connecting rod jointly drive the connecting shaft 18 to rotate. The deep groove ball bearing 19 is mounted on each of both sides of the connecting shaft 18. The deep groove ball bearing 19 can only move in a rectangular groove of the slider 20 and drives the slider 20 to move back and forth on the sliding rail 21. The sliders 20 are arranged symmetrically on the left and right, and the tail end of the slider 20 is connected to the rear end surface of the rubber water storage tank 14. The sliding rails 21 are fixed on the left and right lower cabin bodies 13, respectively. The upper cabin body 12 and the lower cabin body 13 are fixed on the rigid bottom plate 10. When working, the servomotor 15 drives the sliders 20 to move back and forth to change the volume of the rubber water storage tank 14. The lower part of the rubber water storage tank 14 is provided with a drainage port that is connected to the outside of the biomimetic robotic manta ray. When the sliders 20 move forward, the rubber water storage tanks 14 reduce in volume, and drain water out of the biomimetic robotic manta ray to increase the overall buoyancy and move the center of gravity of the biomimetic robotic manta ray backward to enable the biomimetic robotic manta ray to float. When the sliders 20 move backward, the rubber water storage tanks 14 increase in volume, and draw water into the biomimetic robotic manta ray to reduce the overall buoyancy and move the center of gravity of the biomimetic robotic manta ray forward to enable the biomimetic robotic manta ray to submerge.

The control assembly includes a control unit and a battery pack unit. The control unit includes an underlying control chip and a high-performance processing chip. The control unit is located directly behind the water suction and drainage mechanism, and is placed in the isolation cabin 22 together with the battery pack unit. The isolation cabin 22 is mainly configured to isolate the water suction and drainage mechanism to avoid the penetration of lubricating oil and water in case of an accident. The control unit communicates with each electrical component in the biomimetic robotic manta ray through a signal. The control unit mainly includes the high-performance chip 23 for processing a complex task and the underlying driver board 24 for processing a simple control task. In addition, the underlying driver board 24 is further equipped with a voltage stabilizing module and several on-board sensors. The battery pack unit includes six separate rechargeable lithium batteries 25 to provide power for all electrical components in the biomimetic robotic manta ray.

Figure 6:
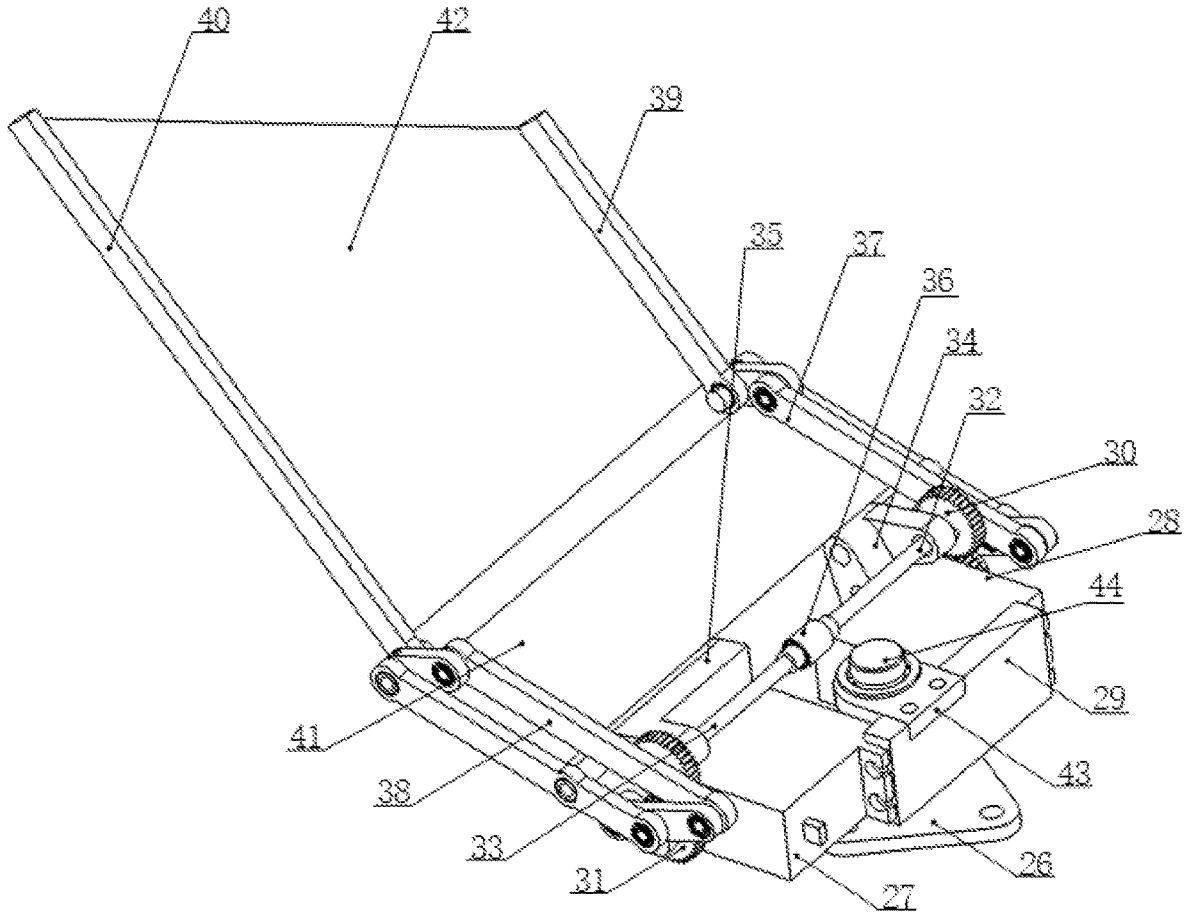
FIG. 6 is a first schematic view of a pectoral fin on a side of the biomimetic robotic manta ray according to the embodiment of the present invention.

In the present invention, the left pectoral fin and the right pectoral fin have the same structure, and thus only the overall structure of the right pectoral fin is described with reference to FIG. 6. The right pectoral fin mainly includes a pectoral fin body, a first power device and a second power device. The first power device and the second power device both communicate with the control unit through a signal. Each pectoral fin body includes at least two crank-rocker mechanisms arranged front and back and flexible membranes unfolded by the at least two crank-rocker mechanisms. The second power device drives the fixing member to rotate through a bevel gear mechanism. The bevel gears are configured to provide a horizontal degree of freedom for the right pectoral fin. In addition, the pectoral fin body further includes two gear sets for transmitting power to the crank-rocker mechanisms. The pectoral fin bodies are separately driven by a first power device to be rotatably mounted on a fixing member around a substantially anteroposterior axis. The fixing members are separately driven by a second power device to be rotatably mounted in the central cabin around a substantially vertical axis. The flexible membranes on the pectoral fin body move with the pectoral fin body and serve as main bearing surfaces. A control terminal of the first power device and a control terminal of the second power device both communicate with the control assembly through a signal. The control assembly controls the first power device and the second power device to adjust the motion of the pectoral fin, so as to adjust the pitch angle and the roll angle of the biomimetic robotic manta ray.

In the present embodiment, the first power device and the second power device preferably adopt waterproof servomotors. The first power device includes the servomotor 28 and the second power device includes the servomotor 27. In the present embodiment, the fixing member includes the support plate 26. The right pectoral fin is fixedly connected to the central cabin shell 6 through the support plate 26. The servomotor 27 and the servomotor 28 are mounted on the support plate 26. The fixing member further includes the servomotor support plate 29 and the support member 43 fixed on the rotating shaft 44. The servomotor 27 and the servomotor 28 are fixedly connected through the servomotor support plate 29.

The servomotor 27 is configured to drive the bevel gear mechanism to provide a horizontal degree of freedom for the right pectoral fin. The servomotor 28 is a continuous rotation servomotor and responsible for driving the crank-rocker mechanisms to move. The servomotor 28 transmits power to the gear set 30 and the gear set 31, and drives the front and back crank-rocker mechanisms to move. The gear set 30 and the gear set 31 are connected by the shaft 32, the gear sleeve coupling 36 and the shaft 33. The shaft 32 and the shaft 33 are supported by the support frame 34 and the support frame 35, respectively. Specifically, the shaft 32 and the shaft 33 are correspondingly provided with gears at their ends close to each other. The opposite gears on the shaft 32 and shaft 33 are connected by a gear sleeve to form the gear sleeve coupling 36. The meshing position of the gear sleeve coupling 36 is manually adjusted to achieve different rotation phases of the two shafts, and the rotation phase difference between the two gear sets 30, 31 is changed to change the motion phase difference between the crank-rocker mechanisms. Output rods of the two crank-rocker mechanisms include rods 37, 38, 39, 40. The flexible membrane 41 and the flexible membrane 42 are fixed on the four output rods, and move with the output rods and serve as main bearing surfaces. The support member 43 drives the right pectoral fin to rotate horizontally around the rotating shaft 44. When the two crank-rocker mechanisms are driven by the servomotor 28, the flexible membranes 41, 42 are driven to flap up and down.

Since the rod 38 and the rod 40, as well as the rod 37 and the rod 39, have different motion phases, the flapping of the flexible membranes 41, 42 in a vertical plane is asynchronous, resulting in an undulatory phase difference along the spanwise direction of the biomimetic robotic manta ray. The meshing position of the gears and the gear sleeve in the gear sleeve coupling 36 is manually adjusted so that the two crank-rocker mechanisms move in different phases. At this time, the rod 37 and the rod 38, as well as the rod 39 and the rod 40, oscillate asynchronously in the horizontal direction to drive the flexible membranes 41, 42 to undulate in the chordwise direction of the water flow. Therefore, the right pectoral fin is capable of imitating the two vertical undulations of a pectoral fin of a natural manta ray by relying on only one servomotor and two crank-rocker mechanisms. In addition, the flexible membrane 41 and the flexible membrane 42 are also able to rotate horizontally around the rotating shaft 44 to keep the rod 40 away from the tail end of the rotating shaft 44, and have the ability to achieve complex spatial motion to imitate a complex motion performed by the tail end of the pectoral fin of the natural manta ray.

Figure 7:
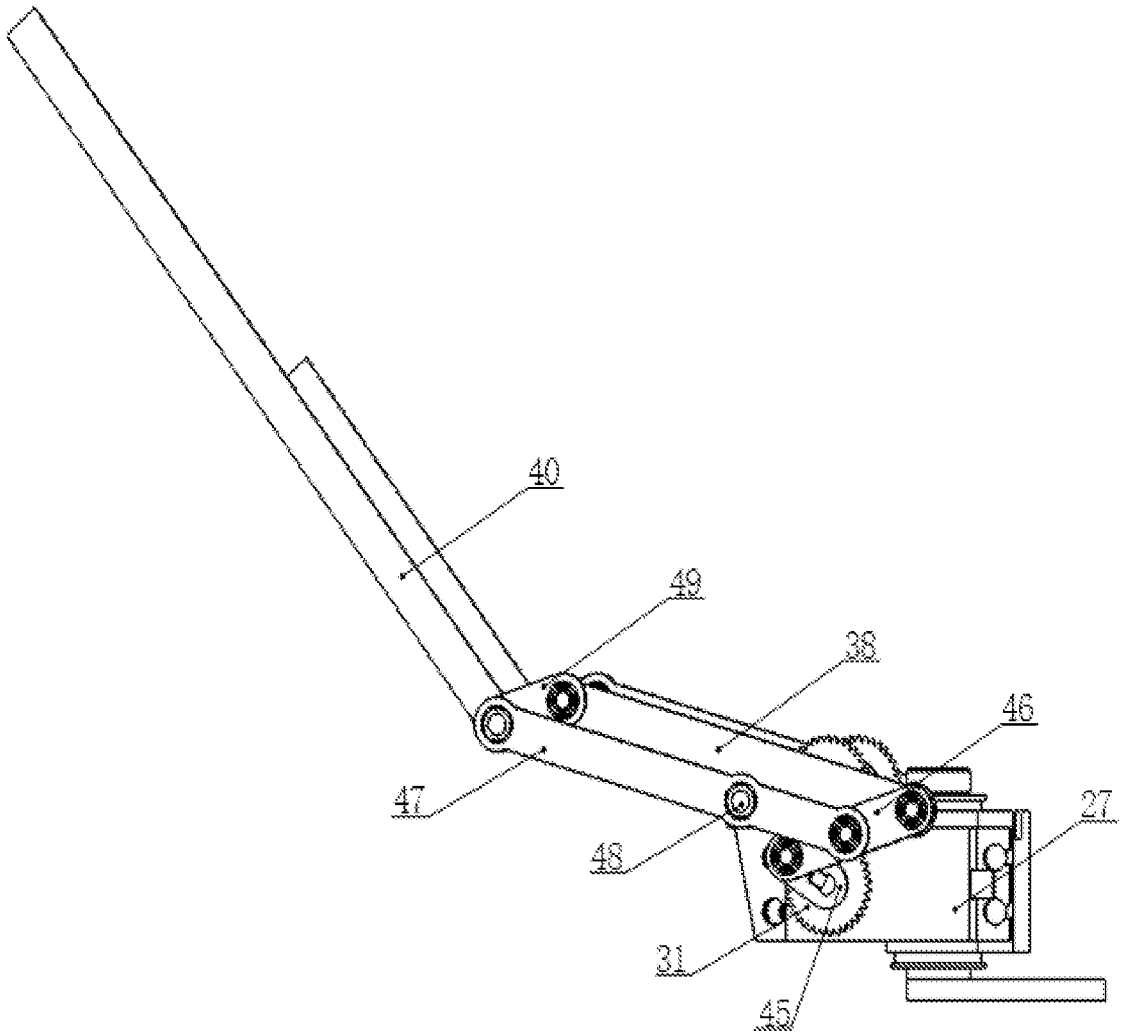
FIG. 7 is a second schematic view of the pectoral fin on the side of the biomimetic robotic manta ray according to the embodiment of the present invention.

FIG. 7 shows the basic structure of the crank-rocker mechanism. The crank 45 is fixedly connected to an output position of the gear set 31, and is connected to the rocker 46 through a planar revolute pair. The rocker 46 is rotatably connected to the connecting rod 38 and the connecting rod 47. The connecting rod 47 is supported by the cantilever support shaft 48. The cantilever support shaft 48 and the servomotor 27 remain relatively stationary. The connecting rod 38 is rotatably connected to an L-shaped driven rod, and the L-shaped driven rod is formed by fixedly connecting the rod 49 and the output rod 40 at a certain angle. When rotating, the gear set drives the entire crank-rocker mechanism to move with it.

Figure 8:
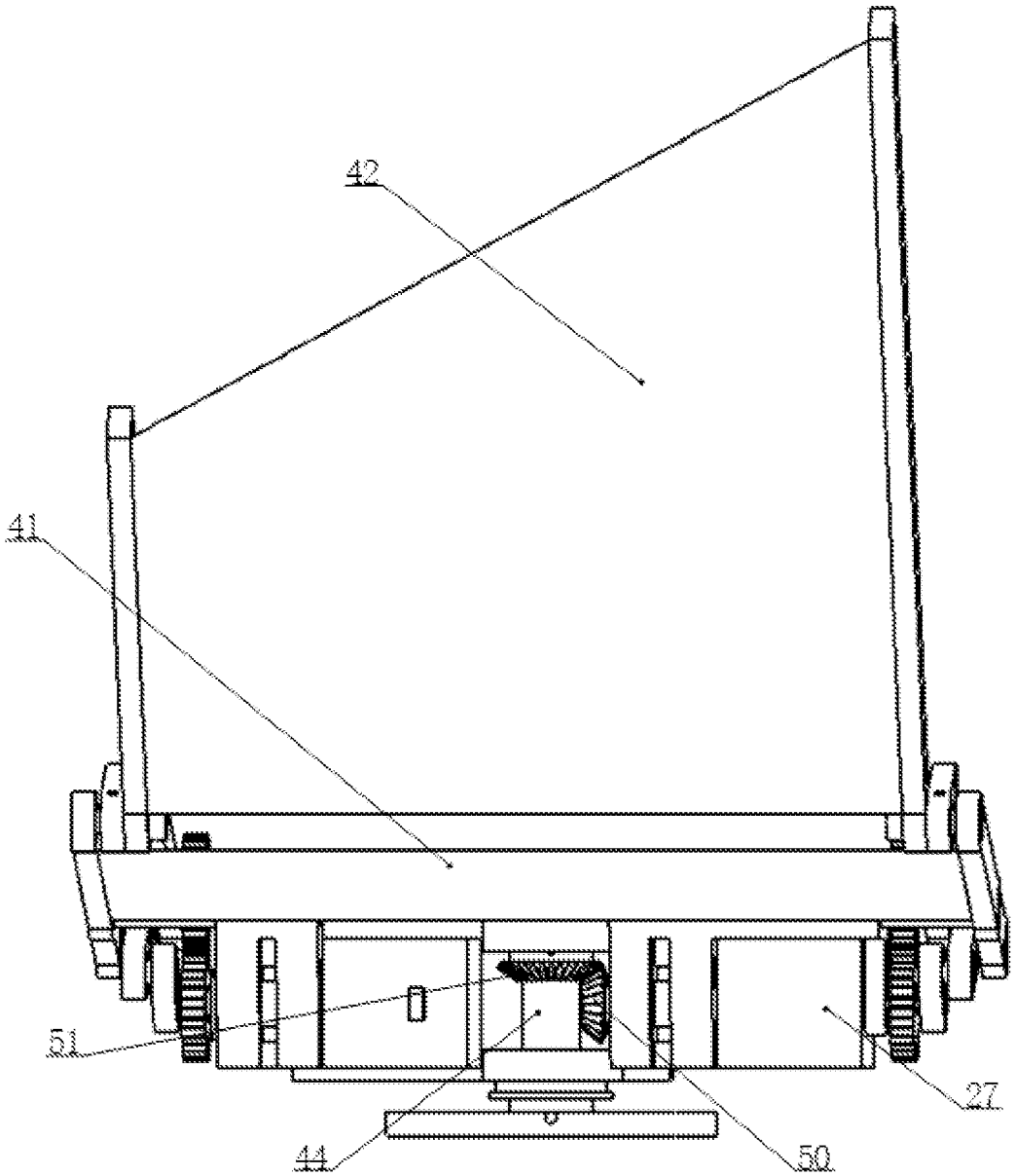
FIG. 8 is a third schematic view of the pectoral fin on the side of the biomimetic robotic manta ray according to the embodiment of the present invention.

FIG. 8 schematically shows the structure of the bevel gear mechanism. The bevel gear 50 meshes with the bevel gear 51, and is driven by the servomotor 27. The bevel gear 51 and the rotating shaft 44 are fixedly connected and remain relatively stationary. When the bevel gear mechanism works, the flexible membrane 41 and the flexible membrane 42 are driven by the servomotor 27 to rotate horizontally around the rotating shaft 44.

Figure 9:
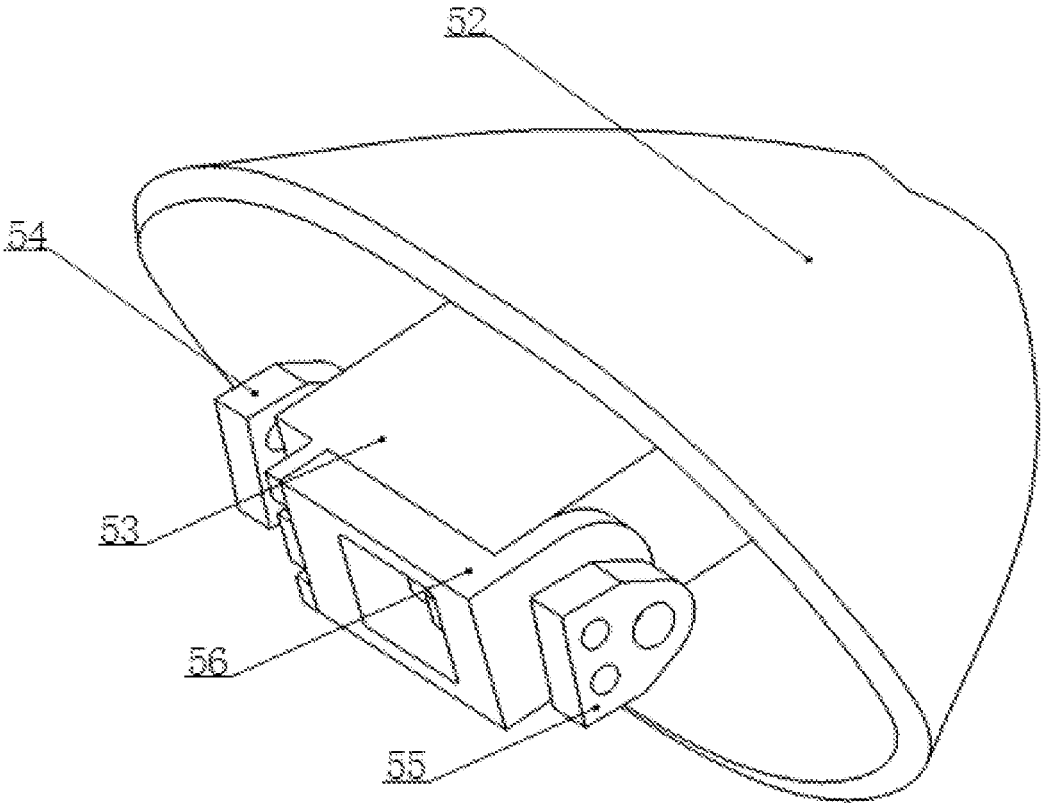
FIG. 9 is a schematic view of a caudal fin cabin of the biomimetic robotic manta ray according to the present invention.

FIG. 9 shows the basic structure of the caudal fin cabin. As shown in FIG. 9, the caudal fin cabin includes the caudal shell 52, a third power device, the caudal fin support frame 54 and the caudal fin support frame 55. The third power device communicates with the control unit through a signal. Preferably, in the present embodiment, a waterproof servomotor serves as a power source of the third power device, and the third power device includes the servomotor 53 and the servomotor support frame 56. In the present embodiment, the caudal shell 52 is fabricated by imitating the shape of a caudal fin of a natural manta ray. The servomotor 53 is fixedly connected to the caudal shell 52. The servomotor 53 is connected to the central cabin through the caudal fin support frame 54, the caudal fin support frame 55 and the servomotor support frame 56, and rotates around the caudal fin support frames 54, 55. When the caudal fin cabin works, the caudal shell 52 is driven by the servomotor 53 to oscillate up and down around a substantially left-right axis to generate a longitudinal thrust, so as to adjust the pitch attitude of the biomimetic robotic manta ray.

The above-mentioned technical solutions in the embodiments of the present invention at least have the following technical effects and advantages.

The biomimetic robotic manta ray of the present invention accurately reproduces the motion mode of the pectoral fins of a natural manta ray through the crank-rocker mechanisms. On one hand, the rigid drive rod provides sufficient power to ensure the swimming speed of the biomimetic robotic manta ray. On the other hand, the accurate reproduction of the motion mode of the pectoral fins of the natural manta ray ensures high swimming efficiency of the biomimetic robotic manta ray.

The biomimetic robotic manta ray of the present invention relies on the coordination of the left and right pectoral fins to achieve rolling and yawing with high flexibility. The biomimetic robotic manta ray achieves not only basic undulatory straight swimming, turning and gliding but also complex 3D motions through the coordination of the left and right pectoral fins, the caudal fin cabin and the water suction and drainage mechanism.

In addition to the undulatory propulsion mode, the biomimetic robotic manta ray of the present invention relies on a newly designed water suction and drainage mechanism to achieve gliding motion. In the undulatory propulsion mode, the biomimetic robotic manta ray adjusts its roll, yaw and pitch attitudes through a pair of pectoral fins and a caudal fin with high flexibility. In the gliding and swimming mode, the biomimetic robotic manta ray adopts a buoyancy-driven method, which consumes less energy and thus has a strong endurance.

The biomimetic robotic manta ray of the present invention adopts an undulatory propulsion method, and thus has high stability when swimming. The biomimetic robotic manta ray has an information acquisition unit and can be equipped with vision, depth and other sensors to perform a series of underwater operations. It thus has broad application prospects in underwater environment monitoring, underwater surveillance, underwater search and rescue, underwater survey, and the like.

On the basis of fewer power components, the biomimetic robotic manta ray of the present invention accurately reproduces the complex motion mode of the pectoral fin of a natural manta ray, and gains the ability to glide while ensuring rapidity and efficiency. In addition, the various cabins are modularly designed to facilitate the disassembly and maintenance of the biomimetic robotic manta ray.

It should be noted that in the description of the present invention, terms such as "central", "upper", "lower", "left", "right", "vertical", "horizontal", "in/inside" and "out/outside" indicate orientation or position relationships based on the drawings, and are merely intended to facilitate description, rather than to indicate or imply that the mentioned device or component must have a specific orientation and must be constructed and operated in a specific orientation. Therefore, these terms should not be construed as a limitation to the present invention. Moreover, the terms such as "first", "second" and "third" are used only for the purpose of description and are not intended to indicate or imply relative importance.

It should be noted that in the description of the present invention, unless otherwise clearly specified, the meanings of terms "install/mount", "connected to" and "connection" should be understood in a broad sense. For example, the connection may be a fixed connection, a removable connection, or an integral connection; may be a mechanical connection or an electrical connection; may be a direct connection or an indirect connection via a medium; or may be an internal communication between two components. Those skilled in the art should understand the specific meanings of the above terms in the present invention based on specific situations.

In addition, the terms "include/comprise", or any other variations thereof are intended to cover non-exclusive inclusions, so that a process, an article, or a device/apparatus including a series of elements not only includes those elements, but also includes other elements that are not explicitly listed, or also includes elements inherent in the process, the article or the device/apparatus.

Hereto, the technical solutions of the present invention have been described with reference to the preferred implementations and drawings. Those skilled in the art should easily understand that the scope of protection of the present invention is apparently not limited to these specific implementations. Those skilled in the art may make equivalent changes or substitutions to the relevant technical features without departing from the principles of the present invention, and the technical solutions derived by making these changes or substitutions shall fall within the scope of protection of the present invention.

What is claimed is:

1. A biomimetic robotic manta ray, comprising a head cabin, a central cabin, a pair of pectoral fins, a caudal fin cabin, and a control assembly;

wherein the head cabin is located at a front end of the biomimetic robotic manta ray;

the central cabin and the caudal fin cabin are sequentially connected to a rear of the head cabin;

the pair of pectoral fins comprise a left pectoral fin and a right pectoral fin, where the left pectoral fin and the right pectoral fin are symmetrically arranged respectively on a left side and a right side of the central cabin;

the left pectoral fin comprises a left pectoral fin body;

the right pectoral fin comprises a right pectoral fin body;

the left pectoral fin includes a left first power device and a left second power device, wherein the left first power device is mounted to a left fixing member and drives the left pectoral fin body around a substantially anteroposterior axis;

the left fixing member is mounted in the central cabin and is driven by the left second power device and the left pectoral fin body rotates around a substantially vertical axis;

the right pectoral fin includes a right first power device and a right second power device, wherein the right first power device is mounted to a right fixing member and drives the right pectoral fin body around a substantially anteroposterior axis;

the right fixing member is mounted in the central cabin and is driven by the right second power and the right pectoral fin body rotates around a substantially vertical axis;

the left pectoral fin body and the right pectoral fin body are separately driven; and a control terminal of the first power device and a control terminal of the second power device both communicate with the control assembly through a first signal.

2. The biomimetic robotic manta ray according to claim 1, wherein each pectoral fin body of the pair of pectoral fins comprises at least two crank-rocker mechanisms arranged front and back and flexible membranes unfolded by the at least two crank-rocker mechanisms; and the second power device drives the fixing member to rotate through a bevel gear mechanism.

3. The biomimetic robotic manta ray according to claim 2, wherein a structure of the crank-rocker mechanism specifically comprises a crank, a rocker, a connecting rod assembly and an L-shaped driven rod; wherein the crank is rotatably connected to a first end of the rocker, and a second end of the rocker is rotatably connected to the L-shaped driven rod through the connecting rod assembly;

the connecting rod assembly has a support point fixed to the first power device;

the connecting rod assembly comprises two connecting rods with an identical length;

the two connecting rods with the identical length are arranged in parallel between the rocker and the L-shaped driven rod;

both ends of each of the two connecting rods with the identical length are rotatably connected to the rocker and the L-shaped driven rod; and the first power device drives the crank to drive the entire crank-rocker mechanism to rotate.

4. The biomimetic robotic manta ray according to claim 3, wherein each of the pectoral fin bodies relies on a coordination of the at least two crank-rocker mechanisms to perform a periodic motion to enable the biomimetic robotic manta ray to perform an undulatory propulsion; and when a left-right motion of the at least two crank-rocker mechanisms is asymmetric, a roll angle and a yaw angle of the biomimetic robotic manta ray are changed.

5. The biomimetic robotic manta ray according to claim 4, wherein each pectoral fin body of the pair of pectoral fins comprises a gear sleeve coupling, and the gear sleeve coupling is configured to change a phase difference of the crank-rocker mechanism along a chordwise direction of a water flow.

6. The biomimetic robotic manta ray according to claim 1, wherein the central cabin is provided with a water suction and drainage mechanism;

a control terminal of the water suction and drainage mechanism communicates with the control assembly through a second signal to enable the biomimetic robotic manta ray to float or submerge;

the caudal fin cabin comprises a caudal fin body and a third power device;

the third power device communicates with the control assembly through a third signal; and the third power device is configured to drive the caudal fin body to rotate around a substantially left-right axis to enable the biomimetic robotic manta ray to perform a pitching motion.

7. The biomimetic robotic manta ray according to claim 6, wherein the water suction and drainage mechanism comprises a flexible water storage tank;

the flexible water storage tank communicates with an outside of a shell of the biomimetic robotic manta ray; and the water suction and drainage mechanism is configured to enable the flexible water storage tank to draw or drain water.

8. The biomimetic robotic manta ray according to claim 7, wherein the water suction and drainage mechanism further comprises a fourth power device;

the fourth power device communicates with the control assembly through a fourth signal; and a drainage volume of the flexible water storage tank is driven by the fourth power device to change to adjust a center of gravity and a buoyancy of the biomimetic robotic manta ray.

9. The biomimetic robotic manta ray according to claim 1, wherein an information acquisition unit is mounted in the head cabin, and the information acquisition unit communicates with the control assembly through a fifth signal.

10. The biomimetic robotic manta ray according to claim 1, wherein the control assembly comprises a control unit and a battery pack unit; and the control unit comprises an underlying control chip and a high-performance processing chip.

* * * * *